United States Patent [19]

Cunningham

[11] Patent Number: 4,650,972

[45] Date of Patent: Mar. 17, 1987

[54] HEATING CABLE AND METHOD OF MAKING SAME

[75] Inventor: Donald M. Cunningham, Allegheny County, Pa.

[73] Assignee: Emerson Electric Co., St. Louis, Mo.

[21] Appl. No.: 784,094

[22] Filed: Oct. 4, 1985

[51] Int. Cl.[4] ..... H05B 3/34; H01C 10/00; H01C 3/06

[52] U.S. Cl. ..... 219/549; 338/195; 338/212; 338/214

[58] Field of Search ..... 219/456, 528, 538, 540, 219/543, 548, 549, 544, 553; 338/212, 214, 195; 29/611

[56] References Cited

U.S. PATENT DOCUMENTS

| | | | |
|---|---|---|---|
| 2,861,163 | 11/1958 | Asakawa | 338/224 X |
| 2,978,665 | 4/1961 | Vernet et al. | 338/223 |
| 3,243,753 | 3/1966 | Kohler | 219/505 X |
| 3,509,511 | 4/1970 | Soroka | 338/195 X |
| 4,471,215 | 9/1984 | Blumer | 219/549 X |

*Primary Examiner*—L. T. Hix
*Assistant Examiner*—Douglas S. Lee
*Attorney, Agent, or Firm*—Polster, Polster and Lucchesi

[57] ABSTRACT

A heating cable includes a pair of spaced apart electrical conductors extending the length of the cable. A matrix of filled polymeric material in physical contact with the conductors forms a heat generating web therebetween. The filled polymeric material has a volume resistivity selected to provide a predetermined heat output per unit length of cable. A plurality of macroscopic perforations are punched through the web between the two conductors so that the actual heat output per unit length of cable is a desired value less than the predetermined heat output per unit length. An electrically insulative jacket longitudinally covers the conductors and the web.

8 Claims, 6 Drawing Figures

HEATING CABLE AND METHOD OF MAKING SAME

Background of the Invention

This invention relates to temperature sensitive, electrically resistive material and, more particularly, to an improved heating cable capable of being made with a variety of different heat outputs and an improved method for making heating cable of differing heat outputs.

The essential composition and operation of two-phase, carbon black-filled, self-temperature regulating material incorporating a "thermally expansible" component, such as polyethylene and a "flow preventing" component which is solid in the transition temperature range of expansible material, and the use of such material as a heating element are summarized in U.S. Pat. Nos. 2,978,665 to Vernet et al and 2,861,163 to Asakawa. Since 1961, when the second of these two patents issued, large numbers of patents covering refinements in the composition of such material and methods of manufacture of heat tapes or cables have issued. For example, in U.S. Pat. No. 3,243,753 to Kohler, a composition is described which contains from 25 to 75 percent carbon black about which a polymeric matrix is formed by in situ polymerization.

Such heating cables (hereinafter, the term "cable" will be used to denote both cables and tapes) are used, for example, for freeze protection, for maintaining the flow characteristics of viscous syrups, and the like. In such applications, the heating cables maintain a temperature at which the energy lost through heat transfer to the surroundings equals that gained from the current flowing between two conductors imbedded in the polymeric matrix. It is known that the carbon black-containing matrix can be extruded directly onto a spaced-apart pair of elongate electrodes to form a heating cable which is somewhat dumbell-shaped in cross section. See U.S. Pat. No. 4,286,376 to Smith-Johannsen et al. The extruded polymeric matrix shown in that patent both encapsulates and interconnects the electrodes. Finally, an insulative jacket is extruded over the dumbell-shaped matrix and conductor assembly.

The heating cables manufactured as described above work well. However, different applications require different levels of heat generation ("heat output") per foot. What this means is that the $I^2R$ power generated or dissipated by the cable must be varied from cable-to-cable, depending upon the application. Since the voltage applied to the heating cable is generally fixed, this variation in the heat generated (or power dissipated) must be accomplished by changing the resistive characteristics of the cable from cable-to-cable for the various applications. Presently, this is done by changing the carbon black loading, changing the polymerization materials or parameters (such as temperature profile and speed), or a combination of these factors. In effect, this meant that a different process was required to make cable of each different desired wattage. At a minimum, this required a change in process parameters between runs of cables of different wattages, and it could also involve a change in the materials used as well.

At least one commercially available product partially addresses the problem of the different desired wattages for heating cables. This particular product includes a pair of electrodes extending the length of the cable, which are held apart by a rigid, insulated metal spacer.

A string of heat-generating matrix-like material is wound around the two electrodes, and an adhesive bonding agent is used to help secure the string to the electrodes. Different wattages are achieved by varying the pitch of the string around the two electrodes. For example, a lower heat generation is achieved by spacing the string farther apart, and a higher heat generation is achieved if the string is close together. However, such heating cable is relatively expensive to make and complicated in construction. Because of this particular construction, the outward appearance of heating cable made in this way can also be somewhat lumpy.

One of the objects of this invention is to provide a method for making heating cable which uses the same basic process parameters, no matter what the desired wattage of the final cable.

Another object of this invention is to provide a method which is capable of making cables of various heat outputs, using a single basic starting cable.

Another object is to provide a method of making heating cable which is simple and economical.

Another object of this invention is to provide a heating cable which is relatively inexpensive and simple in construction.

Another object of this invention is to provide a heating cable which is reliable.

Other objects and features of this invention will be apparent to those skilled in the art in light of the following description and accompanying drawings.

SUMMARY OF THE INVENTION

In accordance with this invention, generally stated, a heating cable includes two spaced apart electrical conductors longitudinally extending substantially the entire length of the cable. A web of filled material is in physical contact with and forms a heat generating web between the conductors. The filled material has a volume resistivity selected to provide a predetermined heat output per unit length of cable. A plurality of macroscopic orifices extend through the web of filled material between the two conductors so that the actual heat output per unit length of cable is less than the predetermined heat output per unit length. An electrically insulative jacket longitudinally covers the conductors and the web.

In a second aspect of the invention, a method of making heating cable includes the steps of forming a web of filled material between a pair of conductors, which web generates heat when a predetermined voltage is applied to the conductors. The filled material provides a predetermined heat output per unit length of cable. The method also includes the step of producing a plurality of macroscopic orifices extending through the web to reduce the actual heat output per unit length of cable below the predetermined heat output. The actual heat output is determined by the number and placement of the plurality of orifices.

BRIEF DESCRIPTION OF THE DRAWINGS

Similar reference characters indicate similar parts throughout the several views of the drawings.

DESCRIPTION OF THE PREFERRED EMBODIMENT

Figure 1:
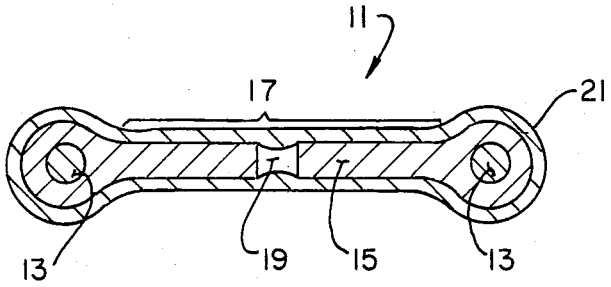
FIG. 1 is a cross sectional view of heating cable of the present invention.

Referring now to the drawings, a heating cable 11 of the present invention includes a pair of spaced apart electrical conductors 13 longitudinally extending substantially the entire length of the cable. A matrix 15, of filled polymeric material (carbon-black being the preferred filler) such as that disclosed in the aforementioned U.S. patents, is formed in physical contact with conductors 13 and forms a heat generating web 17 therebetween. The filled polymeric material is selected to have a volume resistivity which provides a predetermined heat output per unit length of cable. More particularly, the material and the process of curing it is selected so as to maximize the watts dissipated per foot of the cable. A plurality of macroscopic perforations or orifices 19 extend through web 17 between the two conductors so that the actual heat output per unit length of cable is a desired value less than the predetermined heat output per unit length. An electrically insulative jacket 21 longitudinally covers both the conductors and the web. In the remaining figures, insulative jacket 21 is removed for purposes of clarity. Insulative jacket 21 may extend down into orifices 19 as shown or may even fill the orifices without adversely affecting the operating characteristics of cable 11.

Perforations 19 are disposed generally along the centerline or longitudinal axis 23 of cable 11 and are spaced apart a generally constant distance along that axis. The perforations reduce the area of the cable through which current flows between electrodes 13, thereby reducing the heat output of the cable. The heat output can be reduced even further by enlarging perforations 19, by spacing the perforations more closely together, or the like.

Figure 2:
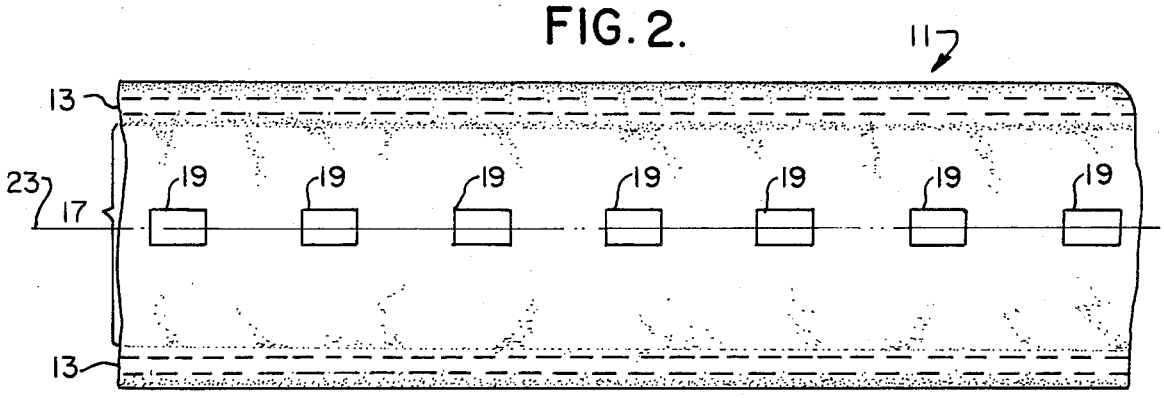
FIG. 2 is a plan view of the heating cable of the present invention, with the insulating jacket removed for clarity.
Figure 3:
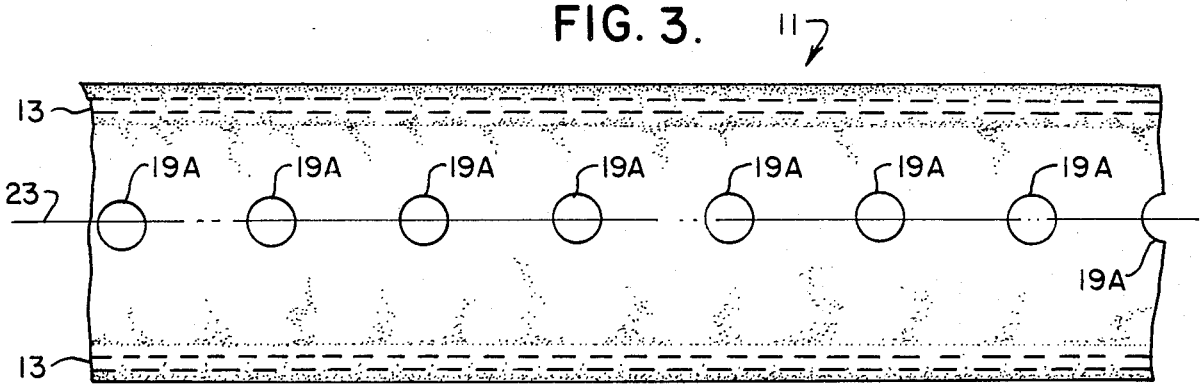
FIG. 3 is a plan view similar to FIG. 2, showing an alternative embodiment of the heating cable of the present invention.
Figure 4:
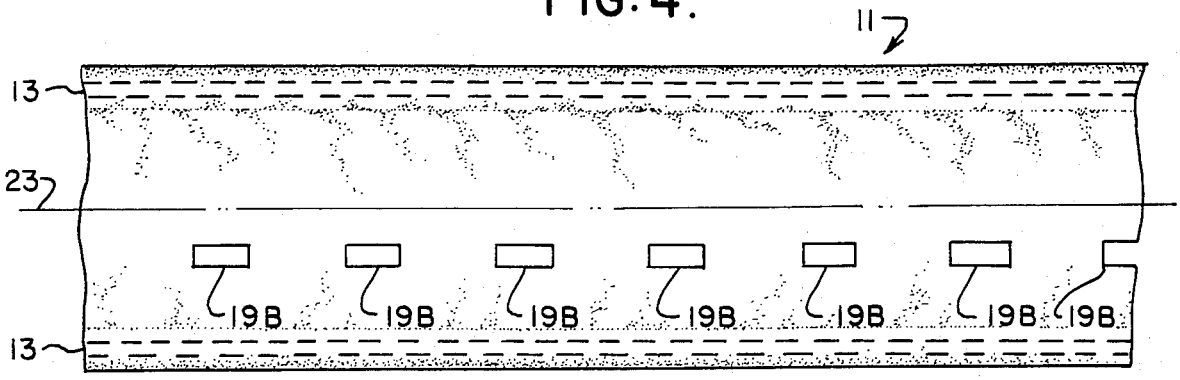
FIG. 4 is a plan view similar to FIG. 2, showing yet another embodiment of the heating cable of the present invention.

Although perforations 19 are shown in FIG. 2 as generally rectangular in plan, the present invention is not so limited. The perforations could also be of any other suitable shape, such as the circular perforation 19A shown in FIG. 3. Similarly, it is not necessary that the perforations be along the centerline of the cable. Perforations 19B, which are offset from the longitudinal axis of the cable, also suitably reduce the heat output of the cable in the same manner as do perforations 19.

Figure 5:
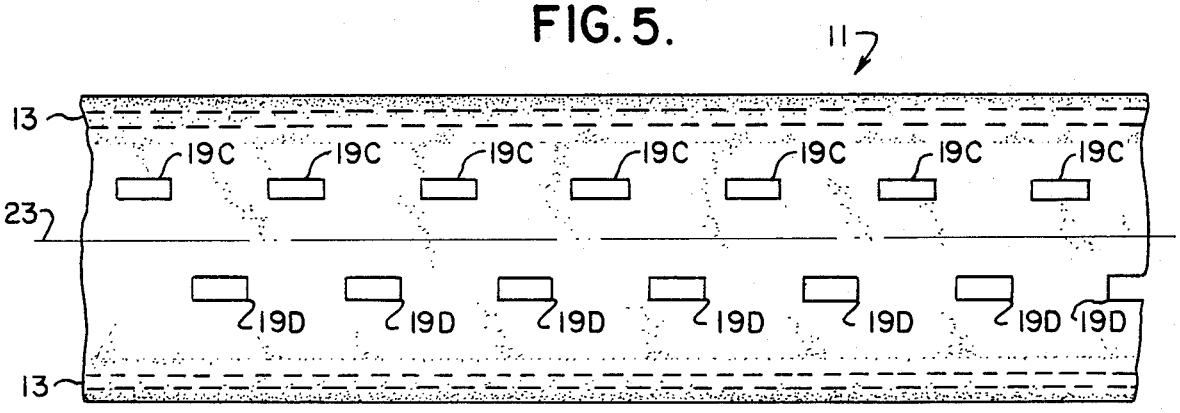
FIG. 5 is a plan view similar to FIG. 2, showing a fourth embodiment of the heating cable of the present invention.
Figure 6:
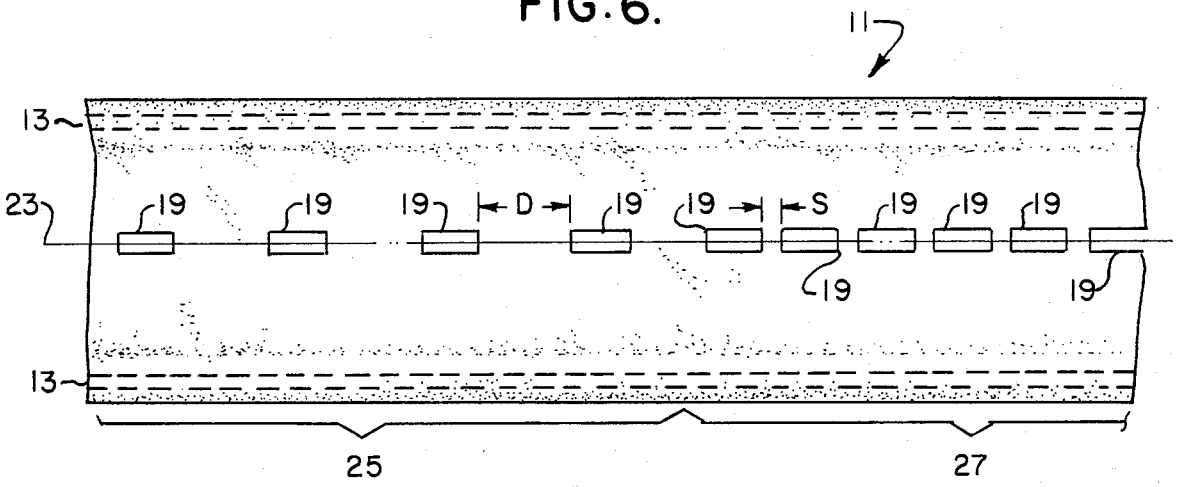
FIG. 6 is a plan view similar to FIG. 2, showing a fifth embodiment of the heating cable of the present invention.

It has been found that the heat output of cable 11 can be reduced to a relatively low level, such as four watts per foot, using the configuration shown in FIG. 2, even though the filled matrix material itself is designed to give the maximum watts per foot. It is possible that one might want to lower the watts per foot so much that the perforations would be spaced too closely together to provide the necessary structural integrity of cable 11 during the assembly process. A configuration such as shown in FIG. 5 is used in this case. In this configuration, the perforations are divided into a first row of perforations 19C disposed on one side of the longitudinal axis of the cable, and a second row of perforations 19D disposed on the other side of the longitudinal axis. This allows the spacing between adjacent perforations as seen from the electrodes to be minimized, while still adding structural integrity to the cable. Many other configurations are also possible; those shown are merely illustrative.

It should also be realized that orifices 19 need not all be equally spaced from their neighbors. For example, if it is desired to have a single heating cable with two different heat output characteristics, the perforations in a first segment 25 of the cable can having a first spacing D, while the perforations in a second segment 27 of the cable can have a different spacing S. In the cable shown, spacing S is much smaller than spacing D so that the heat output of segment 27 is much less than that of segment 25. Extending this further, it should be realized that the heat output characteristics of cable 11 can be varied as desired by appropriate selection of the spacings between adjacent perforations.

The method of the present invention is as follows: Web 17 of suitable filled polymeric material, such as described in the aforementioned U.S. patents, is formed between conductors 13. The polymeric material without perforations provides a predetermined heat output per unit length of cable. Perforations 19 are punched through web 17 to reduce the actual heat output of the unit length of the cable to a desired value below the predetermined heat output. The actual heat output is determined by the number and placement of perforations 19. More particularly, a compound which forms the polymeric matrix is extruded over electrodes 13 in the configuration shown in FIG. 1, but without orifices 19. This compound is selected so that the cable without perforations would have the maximum possible number of watts per feet. This compound is cured with a temperature profile and speed so as to maximize the watts per foot of the polymeric matrix which forms web 17. If it is desired to have a heating cable with a lower heat output than that of the unperforated cable, perforations 19 are formed by punching orifices of any suitable shape in the web 17 between electrodes 13. In addition to varying the size of the perforations to vary the heat output, the spacing between adjacent perforations can also be varied to vary the output. After the desired perforations are punched into web 17, insulating jacket 21 is extruded over the perforated cable to form cable 11.

In view of the above, it will be seen that the various objects and features of the present invention are achieved and other advantageous results attained. It will be apparent to those skilled in the art that numerous modifications can be made to the apparatus and method shown herein without departing from the scope of the invention, as defined in the appended claims.

What is claimed is:

1. A heating cable comprising:

two spaced apart electrical conductors longitudinally extending substantially the entire length of the cable;

a web of filled material in physical contact with and forming a heat generating web between the conductors, said filled material having a volume resistivity selected to provide a predetermined heat output per unit length of cable;

a plurality of macroscopic orifices disposed generally along the longitudinal axis of the cable, said orifices extending through said web between said two conductors such that each orifice is intersected by at least one straight line extending from one conductor to the other, so that the actual heat output per unit length of cable is a desired output less than the predetermined heat output per unit length; and an electrically insulative jacket longitudinally covering said conductors and said web.

2. A heating cable as set forth in claim 1 wherein the spacing between adjacent macroscopic orifices is substantially a constant.

3. A heating cable as set forth in claim 1 wherein the spacing between adjacent orifices in a first segment of the cable differs from the spacing between adjacent orifices in a second segment of the cable so that the heat output of the first cable segment differs from the heat output of the second cable segment.

4. A heating cable as set forth in claim 1 wherein the macroscopic orifices are disposed in a plurality of spaced apart, longitudinally extending rows.

5. The method of making a heating cable comprising the steps of:

forming a web of filled material between a pair of conductors, which web generates heat when a predetermined voltage is applied to the conductors, said filled material providing a predetermined heat output per unit length of cable, said conductors and web extending longitudinally substantially the entire length of the cable; and producing a plurality of macroscopic orifices extending through the web and disposing the orifices generally along the longitudinal axis of the cable to reduce the actual heat output per unit length of the cable below the predetermined heat output, said orifices being disposed such that each orifice is intersected by at least one straight line extending from one conductor to the other, said actual heat output being determined by the number and placement of said plurality of orifices.

6. The method as set forth in claim 5 wherein the macroscopic orifices are perforations produced by punching.

7. The method as set forth in claim 5 including the further step of extruding an insulating jacket over the web after the macroscopic orifices are produced.

8. The method as set forth in claim 5 wherein the spacing of the orifices is selected to provide a desired actual heat generation.

* * * * *